US010637163B2

(12) United States Patent
Wasilko et al.

(10) Patent No.: US 10,637,163 B2
(45) Date of Patent: Apr. 28, 2020

(54) MAGNET WIRE SPLICE TERMINAL

(71) Applicant: TE CONNECTIVITY CORPORATION, Berwyn, PA (US)

(72) Inventors: John Michael Wasilko, Harrisburg, PA (US); Mark Andrew Ondo, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/283,053

(22) Filed: Feb. 22, 2019

(65) Prior Publication Data

US 2019/0363460 A1 Nov. 28, 2019

Related U.S. Application Data

(60) Provisional application No. 62/676,344, filed on May 25, 2018.

(51) Int. Cl.
*H01R 4/10* (2006.01)
*H01R 4/20* (2006.01)
*H01R 4/18* (2006.01)

(52) U.S. Cl.
CPC ..... *H01R 4/20* (2013.01); *H01R 4/18* (2013.01)

(58) Field of Classification Search
CPC ..... H01R 4/18; H01R 4/183; H01R 4/186; H01R 4/187; H01R 4/188; H01R 4/20; H01R 4/203; H01R 4/206
USPC ..... 439/877, 879, 882
See application file for complete search history.

(56) References Cited

U.S. PATENT DOCUMENTS

| | | | | |
|---|---|---|---|---|
| 3,963,857 | A | 6/1976 | Reynolds et al. | |
| 6,779,254 | B1 * | 8/2004 | Herr | H01R 43/052 29/753 |
| 8,016,599 | B1 * | 9/2011 | Melby | H01R 11/30 439/38 |
| 9,362,701 | B2 | 6/2016 | Wasilko et al. | |
| 9,898,119 | B2 | 2/2018 | Yoshida et al. | |
| 2014/0038475 | A1 * | 2/2014 | Harasawa | H01R 4/10 439/877 |
| 2015/0017833 | A1 | 1/2015 | Sato et al. | |

* cited by examiner

*Primary Examiner* — Khiem M Nguyen

(57) ABSTRACT

A splice terminal for connecting a magnet wire to a lead wire. The splice terminal includes a first closed section and a second open section. The first closed section has a first section bottom wall, first section side walls and a first section top wall. An opening is provided between the first section bottom wall, the first section side walls and the first section top wall. The opening is configured to receive the magnet wire therein. The opening has a height between the first section bottom wall and the first section top wall which is larger than the diameter of the magnet wire. The second open section has a second section bottom wall and second section side walls. The second section is configured to receive the magnet wire and the lead wire therein.

20 Claims, 3 Drawing Sheets

MAGNET WIRE SPLICE TERMINAL

FIELD OF THE INVENTION

The invention is directed to a splice terminal for magnet and lead wires. In particular, the invention is directed to a splice terminal which has two termination barrels, one which crimps only the magnet wire and the other which crimps both the magnet wire and the lead wire.

BACKGROUND OF THE INVENTION

Magnet wires are used to form coil windings for a variety of electrical devices. When energized, the coil windings generate magnetic fields and electromagnetic forces to drive, for example, a rotor of an electric motor. When the magnet wire is installed into a stator structure of the motor, the windings cause the rotor to rotate when the stator windings are energized. To supply power to the windings, magnet wire terminals are sometimes employed to couple a power lead wire to the magnet wires.

One type of magnet wire terminal includes an upper saddle which accepts a lead wire or lead wires and a lower saddle which accepts a magnet wire or a number of magnet wires used in the coil windings. When the lead wires and the magnet wires are loaded into the respective upper and lower saddles of the terminal, the terminal is crimped or bent to secure the wires to the terminal. The lower saddle includes serrations formed therein which pierce the insulation of the magnet wires to establish electrical connection to the terminal in the lower saddle when the terminal is crimped. The lead wires are crimped in the upper saddle to establish electrical connection of the lead wire to the terminal. Electrical connections of the lead wires and the magnet wires through the terminal are therefore established.

Loading the wires into the terminal, however, may be problematic, as positioning the wires in the proper saddles may be difficult due to space considerations. In addition, if the wires are not properly positioned, the lead wires may encompass the magnet wire, preventing the proper serration piercing termination of the magnet wire. Therefore, if the magnet wires and lead wires are not positioned properly, the electrical connection through the terminal may be compromised, and the associated electrical device may not function properly.

It would, therefore, be beneficial to provide a terminal splice which ensures the magnet wire(s) and lead wire(s) are properly positioned and terminated.

SUMMARY OF THE INVENTION

An embodiment is directed to a splice terminal for connecting a magnet wire to a lead wire. The splice terminal includes a first closed section and a second open section. The first closed section has a first section bottom wall, first section side walls and a first section top wall. An opening is provided between the first section bottom wall, the first section side walls and the first section top wall. The opening is configured to receive the magnet wire therein. The opening has a height between the first section bottom wall and the first section top wall which is larger than the diameter of the magnet wire. The second open section has a second section bottom wall and second section side walls. The second section is configured to receive the magnet wire and the lead wire therein. The first closed section and the second open section are crimped after the magnet wire and lead wire are positioned in the splice terminal to maintain the magnet wire and the lead wire in position and to provide an electrical connection between the magnet wire and the lead wire.

An embodiment is directed to a crimp terminal integrally formed of a conductive material for electrically interconnecting at least one magnet wire to at least one lead wire. The terminal includes a first closed barrel which has a first barrel bottom wall, first barrel side walls and a first barrel top wall. The first closed barrel has a magnet wire positive stop surface which is configured to cooperate with the at least one magnet wire to position the at least one magnet wire in the first closed barrel. The first closed barrel is configured to receive the at least one magnet wire therein. The second open barrel has a second barrel bottom wall and second barrel side walls. The second open barrel has a lead wire positive stop surface configured to cooperate with the at least one lead wire to position the at least one lead wire in the second open barrel. The second barrel is configured to receive the at least one magnet wire and the at least one lead wire therein.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
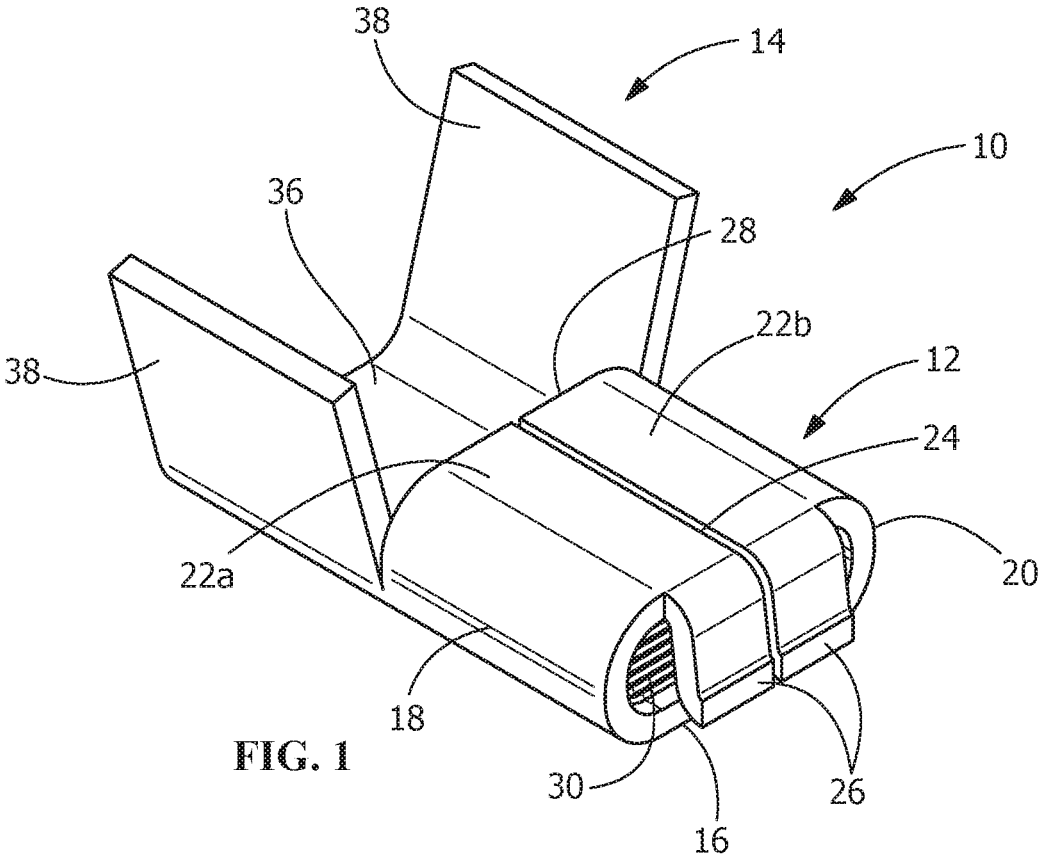
FIG. 1 is a perspective view of an illustrative splice terminal of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

FIG. 1 is a perspective view of a magnet wire splice terminal 10 according to the present invention. The magnet wire splice terminal 10 is integrally formed from a conductive material into a first or closed section or barrel 12 and a second or open section or barrel 14. The first or closed section or barrel 12 includes a bottom wall 16, opposite side walls 18, 20 extending from the bottom wall 16 and a top wall 22. A slot 24 extends the length of the top wall 22 to separate the top wall 22 into a first portion 22*a* and a second portion 22*b*. Magnet wire positive stop surfaces or tabs 26 extend from a front end of the top wall portions 22*a*, 22*b* toward the bottom wall 16. The tabs 26 form a front wall or stop surface, which will be more fully described. Lead wire positive stop surfaces or back edges 28 are provided on the top wall portions 22*a*, 22*b* proximate the second or open section or barrel 14.

Figure 2:
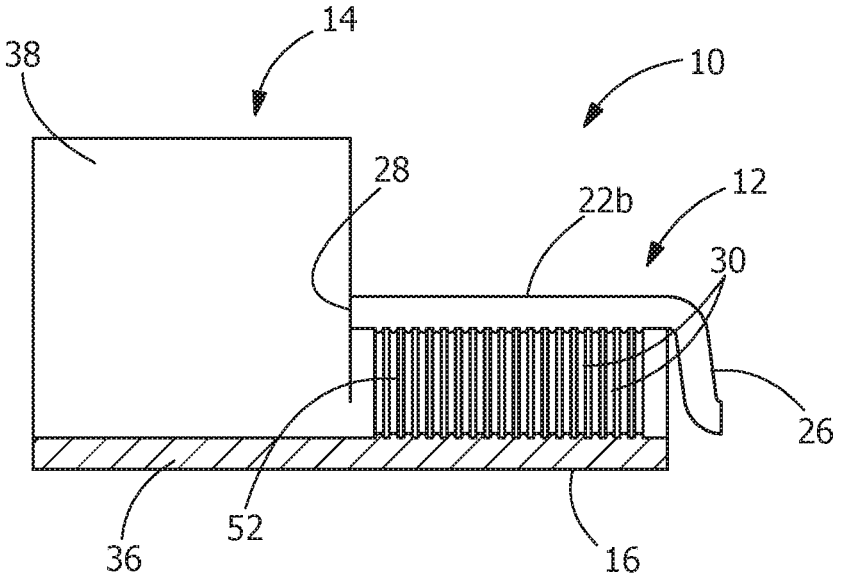
FIG. 2 is a cross-sectional view of the splice terminal of FIG. 1 taken along the longitudinal axis of the terminal.

As best shown in FIG. 2, serrations 30 are provided on the inner surfaces of the first or closed section or barrel 12. In the illustrative embodiment shown, the serrations 30 are positioned on the inside surface of the bottom wall 16, the side walls 18, 20 and the top wall portions 22*a*, 22*b*. However, in other embodiments, the serrations 30 may not be provided on all of the walls. The serrations 30 are configured to pierce through insulation on the magnet wires 32 (FIGS. 3 and 4) loaded into the first or closed section or barrel 12 when the first or closed section or barrel 12 of the magnet wire splice terminal 10 is crimped, as described further below.

As best shown in FIG. 1, the second or open section or barrel 14 includes a bottom wall 36 and opposite side walls 38 extending from the bottom wall 36 at an obtuse angle thereto. The bottom wall 36 is integrally attached and extends continuously from the bottom wall 16 of the first or closed section or barrel 12. The second or open section or barrel 14 is configured to receive the magnet wires 32 and the lead wires 42 therein (FIGS. 3 and 4).

In various illustrative embodiments, serrations may be provided on inside surfaces of the bottom wall 36 and/or the side walls 38. However, in the embodiment shown, serrations are not provided on the bottom wall 36 and/or the side walls 38.

Figure 3:
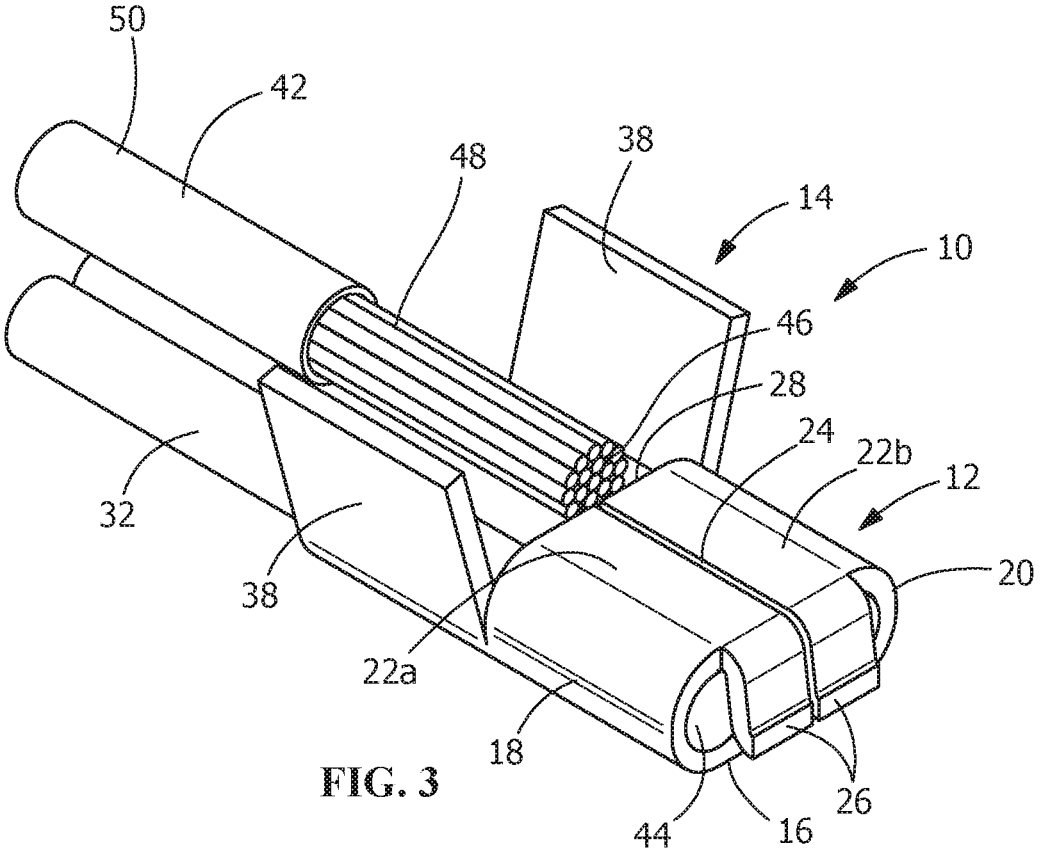
FIG. 3 is a perspective view of the splice terminal of FIG. 1 with a magnet wire positioned in a first crimp section and a lead wire and the magnet wire positioned in the second crimp section.
Figure 4:
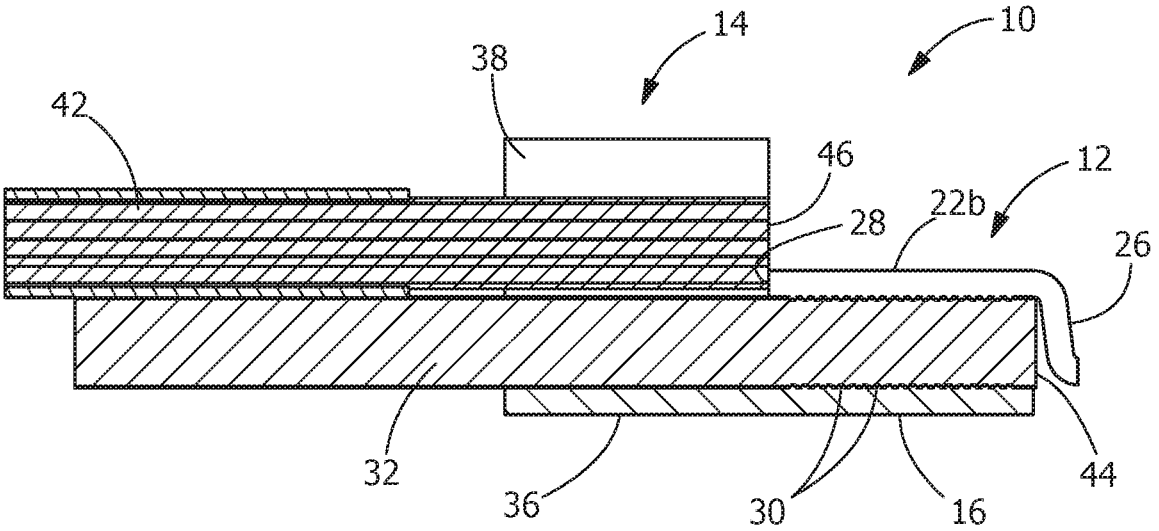
FIG. 4 is a cross-sectional view of the splice terminal of FIG. 3.

FIGS. 3 and 4 illustrate the magnet wire splice terminal 10 with the magnet wires 32 extending through the second or open section or barrel 14 into the first or closed section or barrel 12. In this position, as best shown in FIG. 4, free ends 44 of the magnet wires 32 abut one or both magnet wire positive stop surfaces or tabs 26 of the first or closed section or barrel 12. The magnet wire positive stop surfaces or tabs 26 act as a positive stop to prevent the further insertion of the free ends 44 of the magnet wires 32 into the first or closed section or barrel 12, to properly position the magnet wires 32 in the first or closed section or barrel 12. Each magnet wire 32 also include an outer layer or layers of insulation, enamel coatings, etc. which cover conductive portions of the magnet wire 32. Although two magnet wires 32 are shown in the illustrative embodiment, one or more magnet wires 32 can be inserted into the first or closed section or barrel 12 without departing from the scope of the invention.

FIGS. 3 and 4 illustrate the magnet wire splice terminal 10 with the magnet wires 32 and the lead wire 42 positioned in the second or open section or barrel 14. In this position, as best shown in FIG. 4, the free end 46 of the lead wire 42 abuts one or both lead wire positive stop surfaces or back edges 28 of the top wall portions 22*a*, 22*b* of the first or closed section or barrel 12. The lead wire positive stop surfaces or back edges 28 act as a positive stop to prevent the further insertion of the free end 46 of the lead wire 42 into the second or open section or barrel 14, to properly position the lead wire 42 in the second or open section or barrel 14. Although one lead wire 42 is shown in the illustrative embodiment, one or more lead wires 42 can be inserted into the second or open section or barrel 14 without departing from the scope of the invention.

The lead wire 42 includes a number of conductors 48 surrounded by an insulation sheath 50. The insulation sheath 50 is stripped from the lead wire 42 proximate the second or open section or barrel 14 so that when the magnet wire splice terminal 10 is crimped, an electrical connection is established between the conductors 48 and the second or open section or barrel 14.

In use, the magnet wires 32 are inserted or loaded into an opening 52 of the first or closed section or barrel 12. The opening 52 extends from the back edges 28 of the first or closed section or barrel 12 to the tabs 26. The opening 52 is defined by the bottom wall 16, the side walls 18, 20 and the top wall portions 22*a*, 22*b*. The opening 52 is dimensioned to have a height between the bottom wall 16 and the top wall portions 22*a*, 22*b* which is slightly larger than the diameter of a respective magnet wire 32 to be inserted therein. This allows the magnet wires 32 to be properly inserted into the opening 52 and the first or closed section or barrel 12. The serrations 30 are positioned about the perimeter of the opening 52 to cooperate with the magnet wires 32. In alternative embodiments, the opening may be dimensioned to receive more than one magnet wire.

The magnet wires 32 are inserted into the openings 52 until the free ends 44 of the magnet wires 32 engage the tabs 26 of the first or closed section or barrel 12. The engagement of the free ends 44 with the tabs 26 provides a positive stop to indicate that the magnet wires 32 are properly inserted or loaded into the first or closed section or barrel 12.

The lead wire 42 is inserted or loaded into the second or open section of barrel 14. The lead wire 42 is positioned above the magnet wires 32 which extends through the second or open section or barrel 14 to the first or closed section or barrel 12.

The lead wire 42 is inserted into the second or open section or barrel 14 until the free end 46 of the lead wire 42 engages the back edges 28 of the top wall portions 22*a*, 22*b* of the first or closed section or barrel 12. The engagement of the free end 46 with the back edges 28 provides a positive stop to indicate that the lead wire 42 is properly inserted or loaded into the second or open section or barrel 14.

The magnet wire(s) 32 may be loaded into the magnet wire splice terminal 10 prior to the loading of the lead wire(s) 42 into the magnet wire splice terminal 10. Alternatively, the magnet wire(s) 32 and the lead wire(s) 42 may be loaded into the magnet wire splice terminal 10 at the same time.

With the magnet wire(s) 32 properly inserted into the first or closed section or barrel 12, the first or closed section or barrel 12 is crimped. As this occurs, the serrations 30 pierce through the insulation and coatings on the magnet wire(s) 32 to contact conductive portions of the magnet wire(s) 32. During the crimping process, the first or closed section or barrel 12 is bent to securely retain the magnet wire(s) 32 in the first or closed section or barrel 12.

With the lead wire(s) 42 properly inserted into the second or open section or barrel 14, the second or open section or barrel 14 is crimped. As the crimping occurs, the side walls 38 move toward each other, causing the second or open section or barrel 14 to close. As this occurs, the side walls 38 of the second or open section or barrel 14 are moved into electrical engagement with the conductors 48 of the lead wire(s) 42, thereby establishing a secure electrical connection between the conductors 48 of the lead wire(s) 42 and the second or open section or barrel 14. During the crimping process, the second or open section or barrel 14 is bent to a closed configuration, securely retaining the lead wire(s) 42 and the magnet wire(s) 32 in the second section or barrel 14.

Figure 5:
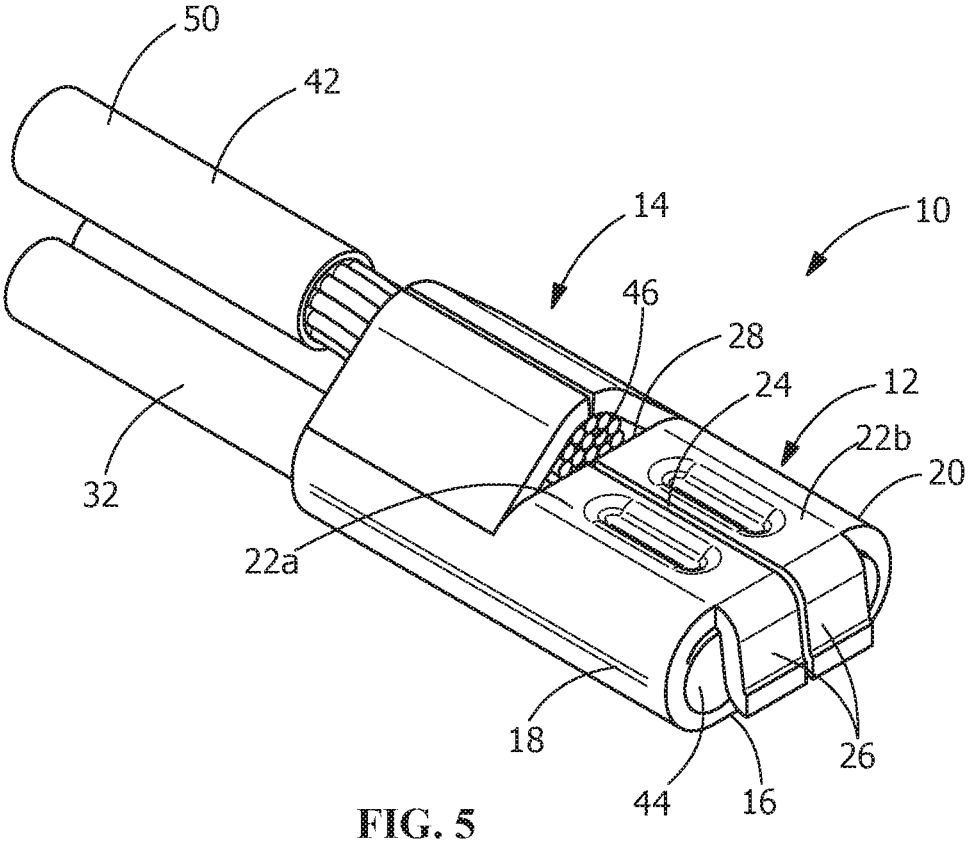
FIG. 5 is a perspective view of the splice terminal of FIG. 3 with the first crimped section crimped to the magnet wire and the second crimped section crimped to the lead wire and the magnet wire.

The magnet wire(s) 32 may be crimped to the first or closed section or barrel 12 prior to the lead wire(s) 42 being crimped to the second or open section or barrel 14. Alternatively, the magnet wire(s) 32 may be crimped to the first or closed section or barrel 12 simultaneously to the lead wire(s) 42 being crimped to the second or open section or barrel 14. The crimping may be done with a manually operated crimping tool or automatically by a machine in a terminal crimping station. The fully terminated magnet wire splice terminal 10 with the magnet wire(s) 32 crimped in the first or closed section or barrel 12 and the lead wire(s) 42 being crimped to the second or open section or barrel 14 is illustrated in FIG. 5.

After crimping the magnet wire splice terminal 10, the lead wire(s) 42 is coupled to a power supply (not shown), and current flows from the lead wire(s) 42 to the second section or barrel 14. The current flows from the second section or barrel 14 to the first section or barrel 12 and ultimately to the magnet wire(s) 32 which may, for example, form a coil winding in an electrical device (not shown).

The splice terminal of the present invention provides a positive stop for the magnet wires, thereby eliminating excess magnet wire from being inserted into the first or closed barrel. Consequently, no excess material is removed from the magnet wires, thereby eliminating scrap material and the potential for subsequent terminal corruption. Similarly, the splice terminal of the present invention provides a positive stop for the lead wires, thereby eliminating excess lead wire from being inserted into the second or open barrel. Consequently, no excess material is removed from the lead wires, thereby eliminating scrap material and the potential for subsequent terminal corruption.

The splice terminal provides the first or closed barrel which receives only the magnet wires and the second or open barrel which receives both the magnet wires and the lead wires. As the lead wires are not present in the first or closed barrel, the piercing of the magnet wires in the first or closed barrel is assured.

While the invention has been described with reference to a preferred embodiment, it will be understood by those skilled in the art that various changes may be made and equivalents may be substituted for elements thereof without departing from the spirit and scope of the invention of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A splice terminal for connecting a magnet wire to a lead wire, the terminal comprising:

a first closed section having a first section bottom wall, first section side walls and a first section top wall, an opening provided between the first section bottom wall, the first section side walls and the first section top wall, the opening configured to receive the magnet wire therein, the opening having a height between the first section bottom wall and the first section top wall which is larger than the diameter of the magnet wire;

a second open section having a second section bottom wall and second section side walls, the second section is configured to receive the magnet wire and the lead wire therein;

wherein the first closed section and the second open section are crimped after the magnet wire and lead wire are positioned in the splice terminal to maintain the magnet wire and the lead wire in position and to provide an electrical connection between the magnet wire and the lead wire.

2. The splice terminal as recited in claim 1, wherein the first section top wall has a first portion and a second portion, the first portion and the second portion are separated by a slot which extends a length of the first section top wall.

3. The splice terminal as recited in claim 1, wherein the first closed section has a magnet wire positive stop surface configured to cooperate with the magnet wire to position the magnet wire in the first closed section.

4. The splice terminal as recited in claim 3, wherein the magnet wire positive stop surface is a tab which extends from the first section top wall toward the first section bottom wall.

5. The splice terminal as recited in claim 1, wherein the second open section has a lead wire positive stop surface configured to cooperate with the lead wire to position the lead wire in the second open section.

6. The splice terminal as recited in claim 5, wherein the lead wire positive stop surface is a back edge of the first section top wall which is provided proximate the second open section.

7. The splice terminal as recited in claim 1, wherein serrations are provided on inside surfaces of the first closed section, the serrations are configured to pierce through insulation of the magnet wire.

8. The splice terminal as recited in claim 7, wherein the serrations are positioned about the perimeter of the opening to cooperate with the magnet wire.

9. The splice terminal as recited in claim 1, wherein the second section side walls extend at an obtuse angle from the second section bottom wall.

10. The splice terminal as recited in claim 1, wherein the second section bottom wall is integrally attached and extends continuously from the first section bottom wall.

11. The splice terminal as recited in claim 10, wherein the splice terminal is formed of a conductive material for electrically interconnecting the magnet wire to the lead wire.

12. A crimp terminal integrally formed of a conductive material for electrically interconnecting at least one magnet wire to at least one lead wire, the terminal comprising:

a first closed barrel having a first barrel bottom wall, first barrel side walls and a first barrel top wall, the first closed barrel having a magnet wire positive stop surface configured to cooperate with the at least one magnet wire to position the at least one magnet wire in the first closed barrel, the first closed barrel configured to receive the at least one magnet wire therein;

a second open barrel having a second barrel bottom wall and second barrel side walls, the second open barrel having a lead wire positive stop surface configured to cooperate with the at least one lead wire to position the at least one lead wire in the second open barrel, the second barrel configured to receive the at least one magnet wire and the at least one lead wire therein.

13. The splice terminal as recited in claim 12, wherein the first barrel top wall has a first portion and a second portion, the first portion and the second portion are separated by a slot which extends a length of the first barrel top wall.

14. The splice terminal as recited in claim 12, wherein the magnet wire positive stop surface is a tab which extends from the first barrel top wall toward the first barrel bottom wall.

15. The splice terminal as recited in claim 12, wherein the lead wire positive stop surface is a back edge of the first barrel top wall which is provided proximate the second open barrel.

16. The splice terminal as recited in claim 12, wherein serrations are provided on inside surfaces of the first closed barrel, the serrations are configured to pierce through insulation of the at least one magnet wire.

17. The splice terminal as recited in claim 12, wherein the second barrel side walls extend at an obtuse angle from the second barrel bottom wall.

18. The splice terminal as recited in claim 12, wherein the second barrel bottom wall is integrally attached and extends continuously from the first barrel bottom wall.

19. The splice terminal as recited in claim 12, wherein an opening provided between the first barrel bottom wall, the first barrel side walls and the first barrel top wall, the opening configured to receive the at least one magnet wire therein, the opening having a height between the first barrel bottom wall and the first barrel top wall which is larger than the diameter of the at least one magnet wire.

20. The splice terminal as recited in claim 19, wherein serrations are positioned about the perimeter of the opening to cooperate with the at least one magnet wire.

* * * * *